US007259954B2

(12) United States Patent
Edstrom et al.

(10) Patent No.: US 7,259,954 B2
(45) Date of Patent: Aug. 21, 2007

(54) ELECTRICAL STATIC DISCHARGE METHOD AND APPARATUS

(76) Inventors: Steven D. Edstrom, 2319 Greenfield Pkwy., Apt. 207, Austin, TX (US) 78741; Donald Richard Veloz, 2502 S. 6th St., Austin, TX (US) 78704

( * ) Notice: Subject to any disclaimer, the term of this patent is extended or adjusted under 35 U.S.C. 154(b) by 0 days.

(21) Appl. No.: 10/464,386

(22) Filed: Jun. 18, 2003

(65) Prior Publication Data

US 2004/0257726 A1 Dec. 23, 2004

(51) Int. Cl.
*H01H 47/00* (2006.01)

(52) U.S. Cl. ..... 361/212; 361/220

(58) Field of Classification Search ..... 361/212, 361/213, 214, 215, 216–226, 56, 220; 141/1, 141/97

See application file for complete search history.

(56) References Cited

U.S. PATENT DOCUMENTS 3,060,605 A * 10/1962 Flack ..... 40/591
6,401,767 B1 * 6/2002 Cohen et al. ..... 141/1
6,549,391 B1 * 4/2003 Bisson ..... 361/223
6,801,418 B1 * 10/2004 Epstein ..... 361/58
6,823,903 B2 * 11/2004 Davis ..... 141/1
7,068,488 B1 * 6/2006 Van Leuven ..... 361/220

FOREIGN PATENT DOCUMENTS

GB 2312645 A * 11/1997

* cited by examiner

*Primary Examiner*—Brian Sircus
*Assistant Examiner*—Danny Nguyen

(57) ABSTRACT

An Electrical Static Discharge (ESD) system comprises a user-accessible subsystem (for example, a first gasoline pump), a local ground, a resistor-fuse element, and a main ground. The local ground dissipates a static electric charge from the user-accessible subsystem. The resistor-fuse element conducts the static electric charge from the local ground, and limits a reverse electric current to the local ground. A main ground receives and dissipates the static electric charge from the resistor-fuse element.

1 Claim, 5 Drawing Sheets

ELECTRICAL STATIC DISCHARGE METHOD AND APPARATUS

BACKGROUND OF THE INVENTION

1. Field of the Invention

The present invention relates generally to electrical protection and safety and, more particularly, to protecting areas having volatile material from electrical static discharge.

2. Description of Related Art

Static electricity is ubiquitous. When a person walks across a carpeted room, friction between the person's feet and the carpet can generate static electricity. When a person uses a portable electronic device such as a cell phone or personal data device, static electricity can be generated. Many electric and electronic devices, improperly grounded, can generate static electricity that a user can carry. Through friction, mechanical devices can also generate static electricity that a user can carry.

Many people think of static electricity as a mildly unpleasant shock experienced occasionally upon touching a doorknob on a cold morning; much smaller static electric discharges, too small to notice, occur very frequently. But static electricity can be much more dangerous than a mild shock might indicate. In fact, even very low currents generated by low-level static electric discharge can be disastrous when generated near combustible materials. Gasoline pumps, storage areas containing flammable or explosive industrial fluids in industrial or commercial buildings, and even under-sink areas in residences can contain flammable gases that can be ignited by static electric discharge.

Many motorists who would never smoke near a gasoline pump at a service station can be seen using cellular telephones while dispensing gasoline. Some motorists are even willing to attempt to jump-start a stalled vehicle, a practice that can easily generate an electric spark. As the use of cellular phones and other electric and electronic devices continues to grow, such practices can be expected to become even more prevalent.

A need thus exists in the prior art for greater electrical protection and safety. A further need exists for protecting areas having volatile material from electrical static discharge.

While the above-described devices fulfill their respective, particular objectives and requirements, the aforementioned patents do not describe an Electrical Static Discharge Method And Apparatus.

Therefore, a need exists for a new and improved electrical protection and safety system and to protecting areas having volatile material from electrical static discharge. A need thus exists in the prior art for electrical protection and safety and, more particularly, for protecting areas having volatile material from electrical static discharge.

SUMMARY OF THE INVENTION

The present invention addresses these needs by providing electrical protection and safety and protecting areas having volatile material from electrical static discharge. In this regard, the present invention substantially fulfills this need. In this respect, Electrical Static Discharge Method And Apparatus according to the present invention substantially departs from the conventional concepts and designs of the prior art, and in doing so provides an apparatus primarily developed for the purpose of electrical protection and safety and to protecting areas having volatile material from electrical static discharge.

In view of the foregoing disadvantages inherent in the known types of Electrical Static Discharge Method And Apparatus now present in the prior art, the present invention provides an improved Electrical Static Discharge Method And Apparatus, and overcomes the above-mentioned disadvantages and drawbacks of the prior art. As such, the general purpose of the present invention, which will be described subsequently in greater detail, is to provide a new and improved Electrical Static Discharge Method And Apparatus which has advantages of the prior art mentioned heretofore and many novel features that result in an Electrical Static Discharge Method And Apparatus which is not anticipated, rendered obvious, suggested, or even implied by the prior art, either alone or in any combination thereof.

To attain this, the present invention essentially comprises an electrical static discharge method and apparatus. The present invention addresses the above-stated needs by providing two basic grounds and safety mats that further isolate any charges making the system superior to others.

Having a system to greatly decrease ESD's unwanted discharge saves money and lives, not to mention lawsuits and litigation expense.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Any feature or combination of features described herein are included within the scope of the present invention provided that the features included in any such combination are not mutually inconsistent as will be apparent from the context, this specification, and the knowledge of one of ordinary skill in the art. For purposes of summarizing the present invention, certain aspects, advantages and novel features of the present invention have been described herein. Of course, it is to be understood that not necessarily all such aspects, advantages or features will be embodied in any particular embodiment of the present invention. Additional advantages and aspects of the present invention are apparent in the following detailed description and claims.

BRIEF DESCIRPTION OF THE FIGURES

The invention will be better understood and objects other than those set forth above will become apparent when consideration is given to the following detailed description thereof. Such description makes reference to the annexed drawings wherein.

DETAILED DESCRIPTION OF THE PRESENTLY PREFERRED EMBODIMENTS

Figure 1:
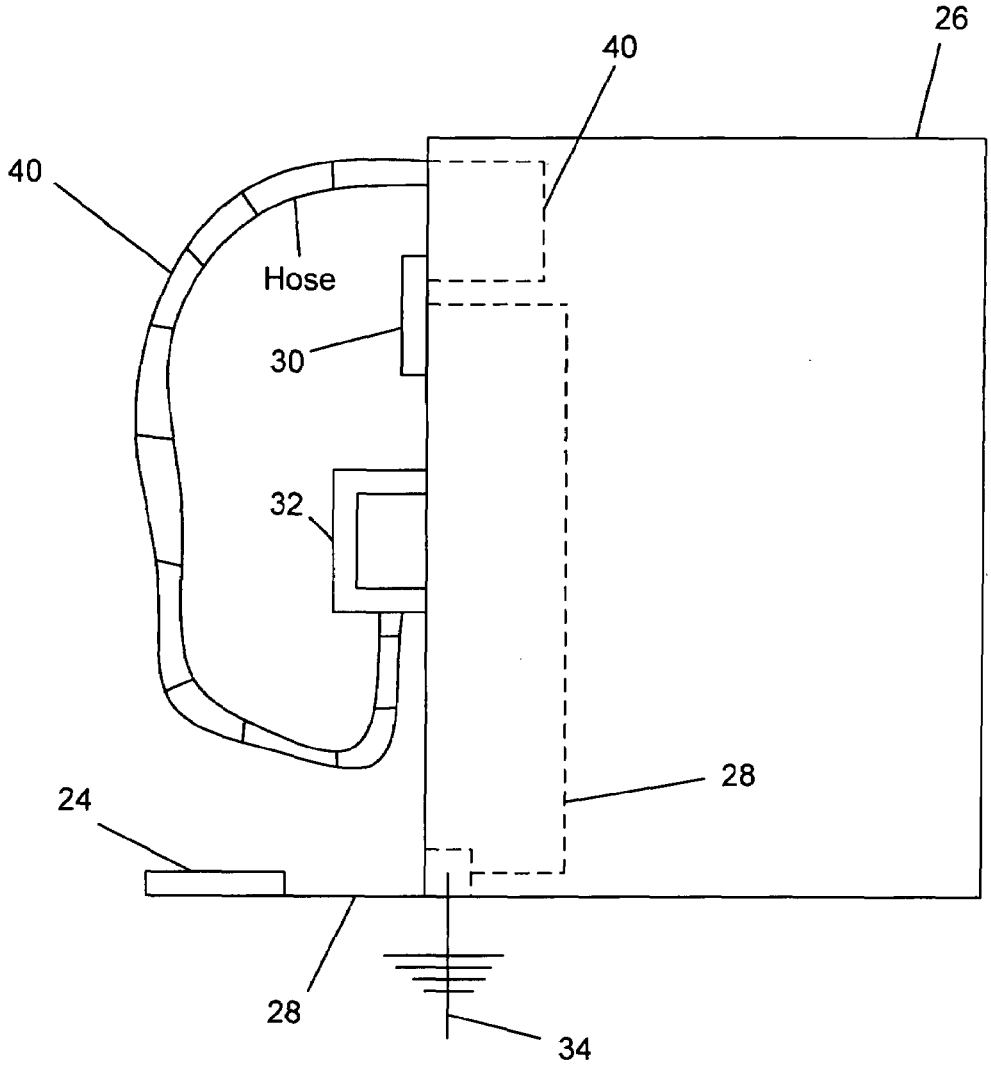
FIG. 1 is an oblique perspective of an Electrical Static Discharge (ESD) system, in accordance with a first embodiment of the present invention.

Reference will now be made in detail to the presently preferred embodiments of the invention, examples of which are illustrated in the accompanying drawings. Wherever possible, the same or similar reference numbers are used in the drawings and the description to refer to the same or like parts. It should be noted that the drawings are in simplified form and are not to precise scale. In reference to the disclosure herein, for purposes of convenience and clarity only, directional terms, such as, top, bottom, left, right, up, down, over, above, below, beneath, rear, and front are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description, although discussing exemplary embodiments, is to be construed to cover all modifications, alternatives, and equivalents of the embodiments as may fall within the spirit and scope of the invention as defined by the appended claims. It is to be understood and appreciated that the process steps and structures described herein do not cover a complete process flow for the manufacture of electrical protection and safety equipment or of equipment for protecting areas having volatile material from electrical static discharge. The present invention may be practiced in conjunction with various electrical protection and safety techniques that are conventionally used in the art, and only so much of the commonly practiced process steps are included herein as are necessary to provide an understanding of the present invention. The present invention has applicability in the field of electrical protection and safety in general. For illustrative purposes, however, the following description pertains to protecting areas having volatile material from electrical static discharge.

Various embodiments of the present invention provide a new and improved Electrical Static Discharge Method And Apparatus that has all or many of the advantages of the prior art and few or none of the disadvantages, overcoming some of the disadvantages normally associated therewith, that may be easily and efficiently manufactured and marketed, that have a low cost of manufacture with regard to both materials and labor, and which accordingly is then susceptible of low prices of sale to the consuming public, thereby making such economically available to the buying public.

Referring more particularly to the drawings, FIG. 1 is an oblique perspective of an Electrical Static Discharge (ESD) system, in accordance with a first embodiment of the present invention. The user-accessible subsystem includes a first gasoline pump 26 operative for dispensing gasoline into a first motor vehicle. The first gasoline pump 26 includes a hose and a handle.

Figure 3:
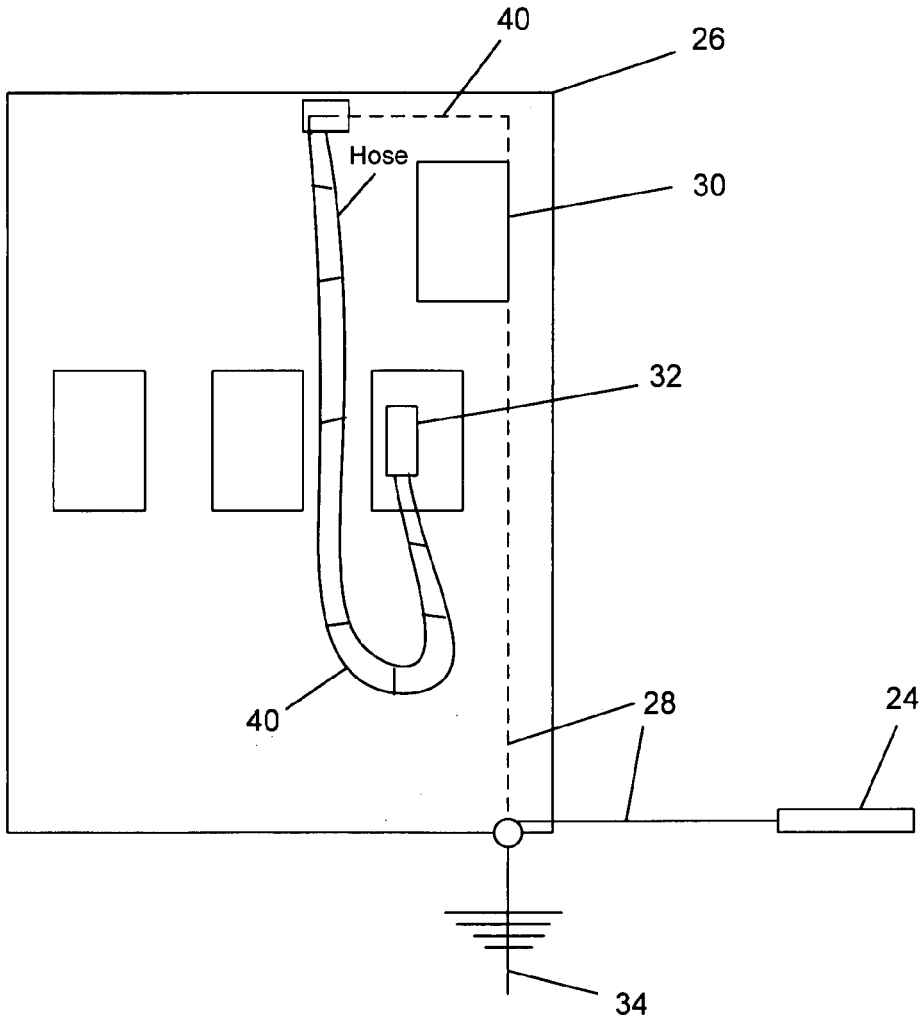
FIG. 3 is a front perspective of an Electrical Static Discharge (ESD) system, in accordance with the first embodiment of the present invention.

FIG. 3 is a front perspective of an Electrical Static Discharge (ESD) system, in accordance with the first embodiment of the present invention. The user-accessible subsystem includes a first gasoline pump 26 operative for dispensing gasoline into a first motor vehicle. The first gasoline pump 26 includes a hose and a handle.

Referring to FIGS. 1 and 3, the user-accessible subsystem includes a mat for a person to stand upon, a touch pad 30 for the person to touch before the user accesses any gas pump 26 of the plurality of gasoline pumps, a handle 32 for the user to touch while the user accesses the plurality of gasoline pumps, a local ground 34, a resistor-fuse element 36 (not shown in FIG. 1), and a main ground (not shown in FIG. 1).

Mat

The user-accessible subsystem also a plurality of electrically isolative mats, including includes a first mat 24. Each mat of the plurality of electrically isolative mats is approved for electric static discharge isolation. The mat 24 is located in front of the first gasoline pump 26, such that a user attempting to use the first gasoline pump 26 will stand on the mat when dispensing gasoline into a first motor vehicle. Each mat of the plurality of electrically isolative mats is grounded to remove stray static electric charge, for example static electric charge from moisture on the ground. The mat conducts the static electric charge from the concrete floor of the service station to the local ground 34 before the user accesses the plurality of gasoline pumps. The user is thus electrically isolated from any static electric charge that may be on the concrete floor.

Figure 2:
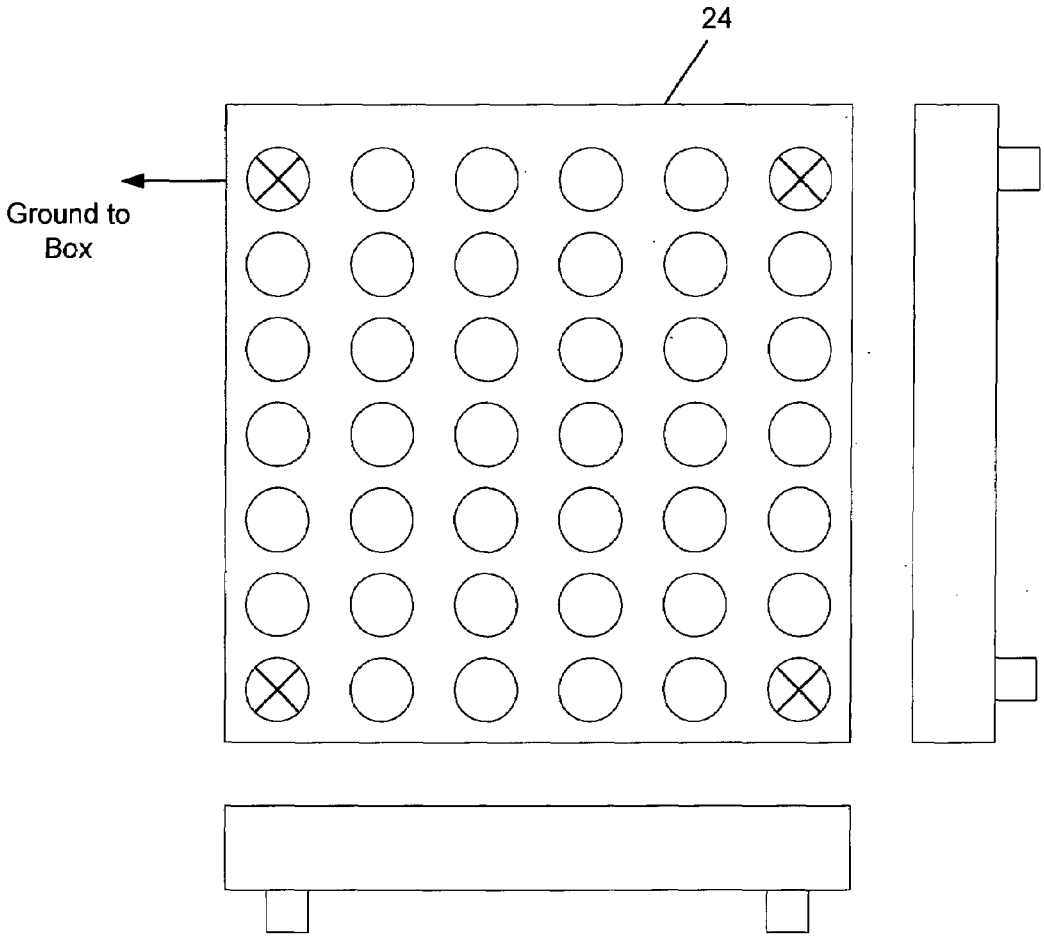
FIG. 2 is a schematic diagram of a mat in accordance with the first embodiment of the present invention.

FIG. 2 is a schematic diagram of a mat in accordance with the first embodiment of the present invention. The mat 24 is large enough for a person to stand upon while using the first gasoline pump 26 to pump the gasoline into a motor vehicle. For example, the first gasoline pump 26 is an island pump situated among several other gasoline pumps. The mat 24 need not be very large.

In accordance with the first exemplary embodiment, the mat 24 may be a rectangular mat measuring three feet by ten feet, and having a thickness of five-eighths of an inch. The mat 24 is placed approximately two feet from a base of the island pump. The mat 24 is anchored by an anchor bolt to prevent its movement. The anchor bolt is, for example, a ⅜" by 10⅞" hex sleeve anchor bolt. The anchor bolt is electrically connected to the mat 24, and can carry electric current to and from the mat 24.

An anchor bolt permanently fixes each of the four corners of the mat 24 to a concrete floor adjacent to the first gasoline pump 26 island. The anchor bolts are driven into the concrete floor using a concrete hammer drill with a ⅜" bit drill and a minimum embedment of 1½" in depth.

A plurality of electrically isolative mats is used. For example, each mat of the plurality of electrically isolative mats is placed such that a distance from a center of a first mat of the plurality of electrically isolative mats to a center of a second mat of the plurality of electrically isolative mats is approximately two feet eight inches (2' 8").

Touch Pad

The user-accessible subsystem also includes a touch pad 30. The touch pad 30 is a metal plate affixed to the first gasoline pump 26 such that a user may touch the user's hand to the touch pad 30. When a user touches the user's hand to the touch pad 30, the touch pad 30 conducts any static electricity that may be present from the user's hand to the local ground 34 before the user dispenses gasoline into a motor vehicle.

The touch pad 30 is mounted on the first gasoline pump 26 in a prominent location where a user may see and easily reach the touch pad 30. In accordance with the first embodiment of the present invention, where the first gasoline pump 26 has a keypad that allows a user to select a grade of gasoline or otherwise enter selections, then the touch pad 30 is mounted on the first gasoline pump 26 immediately adjacent to the keypad. The touch pad 30 may be affixed to the first gasoline pump 26 using ordinary bolts, washers, and nuts. Using bolts, washers, and nuts to secure the touch pad 30 to the first gasoline pump 26 allows the touch pad 30 to remain securely fastened to the first gasoline pump 26 despite the harsh environment of the service station.

The touch pad 30 is electrically connected to an electrically conductive line 28 that runs from the touch pad 30 to the local ground 34. The electrically conductive line 28 may also be affixed to the first gasoline pump 26 and/or to other components of the user-accessible subsystem using ordinary bolts, washers, and nuts. The electrically conductive line 28 may be, but need not be, insulated. If desired, the electrically conductive line 28 may be a metallic slat that is mounted onto the first gasoline pump 26. Accordingly, the touch pad 30 and the electrically conductive line 28 are easily added to a pre-existing first gasoline pump 26 without significant effort. Managers of service stations can quickly and inexpensively retrofit their existing service stations, in accordance with a first embodiment of the present invention.

Once affixed to the first gasoline pump 26, the electrically conductive line 28 provides a path between the touch pad 30 and the local ground 34; the user's hand has a path including the electrically conductive line 28 from the touch pad 30 to the local ground 34. A motorist may simply drive up to the first gasoline pump 26, get out of his/her car, touch a hand to the touch pad 30 to discharge any static electricity that may have accumulated in the user's body, and then begin fueling the motorist's motor vehicle.

In accordance with the first embodiment of the present invention, a resistor between the touch pad 30 and the electrically conductive line 28 limits an electric current associated with the discharge of any static electricity that may be present on the user's body. Accordingly, the user does not receive a significant static-electric shock upon touching the touch pad 30, and is thus not discouraged from touching the touch pad 30 at a later visit to the service station. In some situations, the touch pad 30 need not remove all static electric charge from the user's body; the handle 32 (described immediately below) removes static electric charge from the user's body after the user has touched the touch pad 30. The touch pad 30 primarily serves to protect the user from any static electric shock that the user might otherwise experience upon touching the handle 32.

The electrically conductive line 28 is coupled to conduct electricity to and from the mat 24. Specifically, the electrically conductive line 28 is coupled to conduct electricity to and from the mat 24 via the anchor bolt. The electrically conductive line 28 is, for example, a ten gauge awg 105 cds, and runs from a pump base to the anchor bolt.

The electrically conductive line 28 is coupled to conduct electricity to and from a pump ground. The pump ground is, for example, located within or adjacent to the first gasoline pump 26, and grounds any electrical charge. Accordingly, the mat 24, the electrically conductive line 28, and the pump ground collectively safely ground any electrical static charge that might be in the area of the mat.

The human body can still create static electric charge after the touching the touch pad 30. If a user reaches into the motor vehicle, or rubs against the gasoline pump or some portion of the motor vehicle or anything that may be present at the service station, the human body can create static electric charge. Even friction between the human body and the clothing that the person is wearing can create static electric charge. Even where the overall system does not completely remove static electric charge, however, the overall system can limit the effects and consequences of static electric charge.

Handle

The handle 32 of the first gasoline pump 26 is metallic, or has a metal plate affixed thereto, such that a user may touch the user's hand to the touch pad 30. When a user touches the user's hand to the handle 32, the handle 32 conducts any static electricity that may be present from the user's hand to the local ground 34 before the user accesses the first gasoline pump 26. The handle 32 also conducts any static electricity that may be present from the user's hand to the local ground 34 while the user accesses the first gasoline pump 26. The handle 32 is particularly important for those users who neglect to touch the touch pad 30 before dispensing gasoline.

The handle 32 is electrically connected to a wire 40 that runs along the handle. In accordance with the first embodiment of the present invention, the wire 40 may be affixed to the handle 32 using ordinary bolts, washers, and nuts. Once affixed to the handle 32, a wire 40 provides a path between the handle 32 and the local ground 34. The user's hand has a path including the wire 40 from the handle 32 to the local ground 34. In accordance with the first embodiment of the present invention, the wire 40 is a flexible wire that is tied or strapped to the hose of the first gasoline pump 26.

Accordingly, the wire 40 is easily added to pre-existing plurality of gasoline pumps without significant effort. Managers of service stations can quickly and inexpensively retrofit their existing service stations, in accordance with a first embodiment of the present invention.

In accordance with the first embodiment of the present invention, a resistor between the handle 32 and the wire 40 provides added resistance for the discharge of any static electricity that may be present on the user's body. Accordingly, the user does not receive a significant static-electric shock upon touching the handle 32, and is thus not discouraged from touching the handle 32 at a later visit to the service station. If the user does experience any unpleasant static electric shock upon grasping the handle 32, then the user is thereby encouraged to touch the touch pad 30 before grasping the handle 32.

The wire 40 is, for example, a 10 g to 12 g gauges, and is mounted along a hose running from a the first gasoline pump 26 to the first gasoline pump 26 handle 32. The wire 40 is mounted to the hose with industrial tie straps, preventing the wire 40 from kinking. The wire 40 is coupled to conduct electricity between the touch pad 30 and the pump ground. Accordingly, a person using the first gasoline pump 26 who grasps the first gasoline pump 26 handle 32 is grounded to the pump ground, and the touch pad 30, the wire 40, and the pump ground collectively ground any electrical static charge that may be stored on the person's body.

If desired, in accordance with a third exemplary embodiment of the present invention, the touch pad 30 is eliminated and the wire 40 is connected directly to the handle 32. If desired, in accordance with a fourth exemplary embodiment of the present invention, a second touch pad 30, touchable by a person who intends to dispense gasoline into the motor vehicle and operatively coupled to conduct electricity to and from the electrically conductive line 28, to allow a person who intends to dispense gasoline into the motor vehicle to touch the second touch pad 30 to a remove static electric charge before dispensing gasoline into the motor vehicle.

The handle 32 is mounted on a first gasoline pump, and is in both physical and electrical contact with a hand of any person using the first gasoline pump 26 to allow a hand of the person who is dispensing gasoline into the motor vehicle to be in physical and electrical contact with the touch pad 30. When a person grasps the first gasoline pump 26 handle 32 in a hand, the wire 40 draws away any electrical static charge that may be stored on the person's body.

Local Ground

A local ground 34 is connected to several plurality of gasoline pumps, and serves to dissipate any static electric charge that might be conducted via the wire 40 from the handle 32 of each of the plurality of gasoline pumps to which the local ground 34 is connected. The local ground 34 also serves to dissipate any static electric charge that might be conducted via the wire 40 from the handle 32 of each of the plurality of gasoline pumps to which the local ground 34 is connected.

The local ground 34 is, for example, a metallic feature of the first gasoline pump 26 that is adequately grounded, or pole that is driven into the ground near one of the plurality of gasoline pumps. Most gasoline pumps have some metallic feature that is very well grounded. Since the local ground 34 is located near all of the plurality of gasoline pumps to which it is connected, the Electrical Static Discharge (ESD) system is easily implemented. For example, many service stations offer water or compressed air near the plurality of gasoline pumps; the pipes associated with the water or compressed air distribution may be used as a local ground 34. Many service stations have metal barriers to prevent inattentive motorists from colliding with a first gasoline pump 26; the metal barriers may be used as a local ground 34.

Resistor-Fuse Element

A resistor-fuse element 36 is connected to the local ground 34. The resistor-fuse element 36 allows excess accumulation of static electric charge at the local ground 34 to dissipate from the local ground 34. In many situations, the local ground 34 is sufficient to dissipate all of the static electric charge that motorists produce at the plurality of gasoline pumps. However, if for some reason a large static electric charge has accumulated at the local ground 34 that is too large for the local ground 34 to dissipate, the resistor-fuse element 36 provides an alternate path for the excess electric charge to take.

The resistor-fuse element 36 has a fuse that is blown in response to very large electric currents. The fuse prevents large currents from flowing through the resistor-fuse element 36; the charge is not allowed to pass. In the extremely rare situation in which the large static electric charge that has accumulated at the local ground 34 is too large for the resistor-fuse element 36 to conduct, the resistor-fuse element 36 blows. In response to a blowing of the resistor-fuse element 36, the between the first ground and the main ground is interrupted, and the mat, touch pad, and handle are electrically isolated from the main ground The resistor-fuse element 36 thus provides an additional safety feature.

More importantly, a large reverse current flowing through the resistor-fuse element 36 toward the local ground 34 can also blow the resistor-fuse element 36. For example, if a large power surge occurs at an electric power company or anywhere else within the geographical region serviced by the electric power company, the fuse of the resistor-fuse element 36 prevents large currents from flowing through the resistor-fuse element 36 to the plurality of gasoline handle.

Specifically, a five to fifteen mega-ohm (5-15 MΩ) resistor 38 is placed between the touch pad 30 and the wire 28. The resistor 38 conducts electricity between the touch pad 30 and the electrically conductive line 28. The resistor 38 reduces any current that may pass through the wire 28, eliminating any likelihood of electric shock due to static electricity discharge as the person grasps or touches the touch pad 30 or the first gasoline pump 26 handle 32.

The electrical static discharge system 22 also comprises, among other elements, a fuse. Specifically, the fuse is a quarter-Amp fuse that protects the wire 28. If a current in excess of a quarter-Amp passes through the fuse (i.e., wire 28), the fuse disables the wire 28 and prevents the first gasoline pump 26 from operating until the fuse is reset or replaced.

The fuse resides within a fuse box located at a base of the first gasoline pump 26, and is easily reset or replaced. The fuse box is connected to a ten mega-ohm (10 MΩ) wire and a half-watt resistor with a quarter-Amp buss fuse to limit feedback. If desired, in accordance with a fifth exemplary embodiment of the present invention, the fuse is replaced with a circuit breaker. The fuse box also includes a storage capacity to store an extra length of wire, approximately twelve inches, for servicing purposes.

A storage box is mounted on the side or top of the gasoline pump. The storage box is made of metal or plastic, or other suitable material, and is large enough to store additional wire, fuses, and other resistor-fuse components.

Main Ground

A main ground is connected to the resistor-fuse element 36 and serves to dissipate any static electric charge that might be conducted through the resistor-fuse element 36 from the local ground 34. The main ground is, for example, a ground associated with an electric system that provides electric power to the plurality of gasoline pumps. Since the electric system that provides electric power to the plurality of gasoline pumps already contains a main ground, the Electrical Static Discharge (ESD) system is easily implemented.

Figure 4:
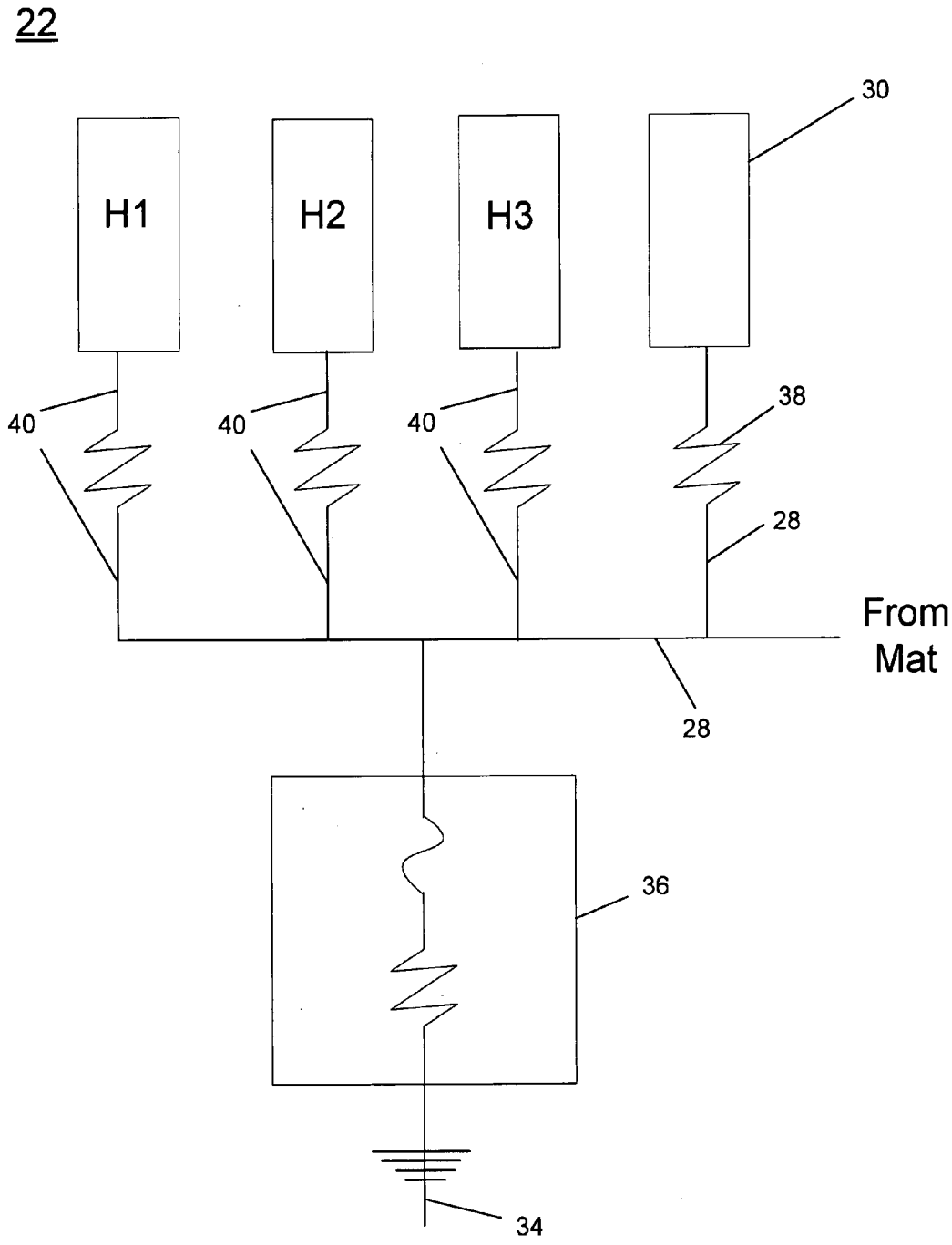
FIG. 4 is a schematic diagram of an Electrical Static Discharge (ESD) system, in accordance with the first embodiment of the present invention.

FIG. 4 is a schematic diagram of an Electrical Static Discharge (ESD) system, in accordance with the first embodiment of the present invention. The Electrical Static Discharge (ESD) system includes a mat (not shown in FIG.

4), a touch pad 30 (also not shown in FIG. 4), a handle 32, a local ground 34, a resistor-fuse element 36, and a main ground.

Overall System

The mat conducts the static electric charge from the user's feet to the local ground 34 before the user accesses the plurality of gasoline pumps. The user may touch the touch pad 30 to allow the touch pad 30 to draw any static electric charge from the user's hand to the local ground 34 before the user accesses the plurality of gasoline pumps. The user may also touch the handle 32 to allow the handle 32 to conduct the static electric charge from the user's hand to the local ground 34 while the user accesses the plurality of gasoline pumps. The handle 32 has a wire 40 along the hose, and the user's hand has a path including the wire 40 from the handle 32 to the local ground 34.

The local ground 34 is mounted on the plurality of gasoline pumps to dissipate a static electric charge from each of the plurality of gasoline pumps of the plurality of gasoline pumps. The resistor-fuse element 36 conducts the static electric charge from the local ground 34, and limits a reverse electric current to the local ground 34. The main ground receives and dissipates the static electric charge from the resistor-fuse element 36.

Sign

Figure 5:
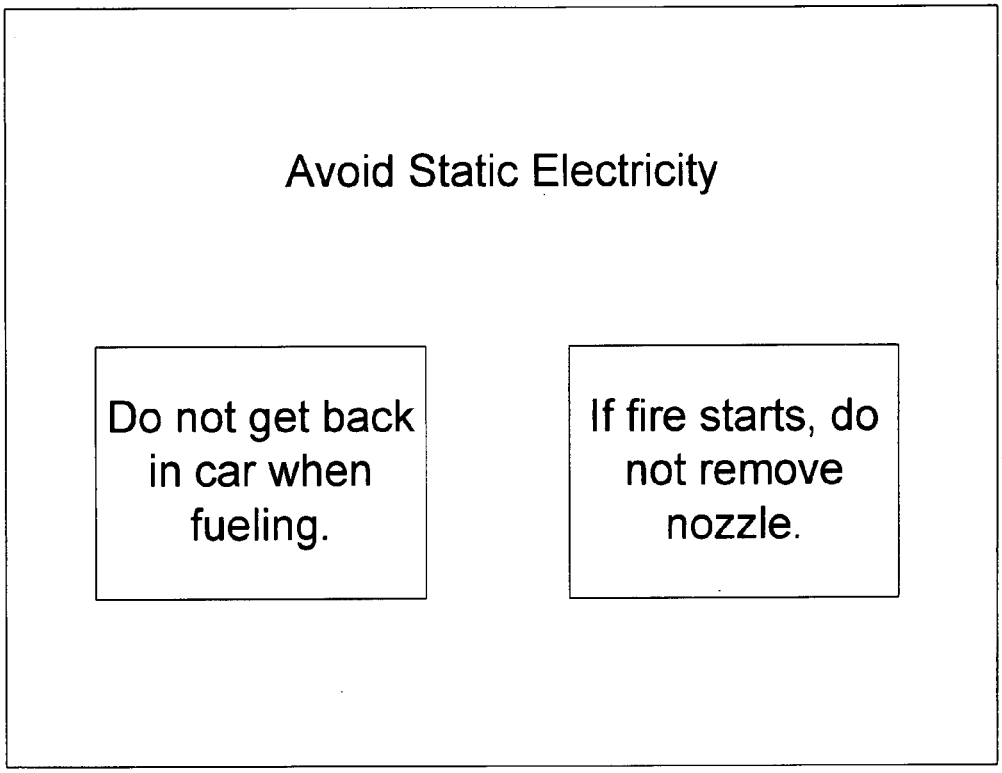
FIG. 5 is a schematic diagram of a sign, specifically an Electrical Static Discharge (ESD) system sign, in accordance with the second embodiment of the present invention.

FIG. 5 is a schematic diagram of a sign, specifically an Electrical Static Discharge (ESD) system sign, in accordance with the second embodiment of the present invention. The sign provides a warning regarding dangers of electrical static discharge. Many motorists are unaware, for example, that using a cellular telephone while dispensing gasoline into a motor vehicle can produce a spark, due to static electric discharge; notifying a motorist when the motorist drives into the service station can help to prevent possible problems. The sign may have holes that allow the sign to be screwed onto the first gasoline pump 26. The sign may also be affixed onto the first gasoline pump 26 using ordinary bolts, washers, and nuts. In accordance with the first embodiment of the present invention, the sign is self-adhesive with a pealable backing covering a self-adhesive surface of the sign. The manager of the service station may simply peal the pealable backing from the sign and mount the sign in an appropriately visible location on the first gasoline pump 26.

The electrical static discharge system 22 also comprises, among other elements, a warning sign. FIG. 5 shows a warning sign in accordance with the first exemplary embodiment of the present invention. The warning sign comprises warning labels pertaining to dangers of electrical static discharge. All warning labels are self adhesive and secured on the plurality of gasoline pumps. The warning sign is itself self-adhesive and comprises a pealable backing covering a self-adhesive surface of the warning sign. In accordance with a sixth exemplary embodiment of the present invention, the warning sign is operative to be screwed onto the first gasoline pump 26. In accordance with a seventh exemplary embodiment of the present invention, the warning sign is affixed onto the first gasoline pump 26.

In accordance with the first exemplary embodiment of the present invention, many of the dangers of electrical static discharge, and many of the safety practices that can minimize risks of danger, might not be immediately obvious to many motorists. For example, many motorists might be unaware of dangers associated with removing a nozzle if a fire has started, or the dangers associated with getting back into a car while fueling. While some motorists might be aware of dangers associated with smoking where gasoline is being dispensed, many are not aware of dangers associated with use of a cell phone or of a pager.

Many of the dangers of electrical static discharge, and many of the safety practices that can minimize risks of danger, might not be immediately obvious to many gasoline station attendants and managers. Many gasoline station attendants and managers are untrained in using a fire extinguisher, and many are not aware of where a fire extinguisher should be located. Many gasoline station attendants and managers are also unaware that some commercially available fire extinguishers are not appropriate for use with respect to electrical fires or chemical fires.

Since fueling a motor vehicle may require several minutes, motorists have sufficient time to read a lengthy list of dangers associated with electrical static discharge. The warning sign may also include other dangers associated with using plurality of gasoline pumps. Since many motorists refuel their motor vehicles several times each month, repeated viewing of the warning sign allows motorists to learn through repeated reading. Even if a list of dangers is lengthy, motorists may learn quite a lot about safety simply by reading the warning sign.

CONCLUSION

The described embodiments of the present invention can be used anywhere that flammable or explosive liquid, gas, or solid is manufactured, transported, stored, used, processed, or dispensed. The use of the flammable or explosive liquid, gas, or solid is thus much safer.

In view of the foregoing, it will be understood by those skilled in the art that the methods of the present invention can facilitate electrical protection and safety and also can facilitate management of gasoline stations, and in particular the electrical protection and safety of gasoline stations. The above-described exemplary embodiments have been provided by way of example, and the present invention is not limited to these examples. Multiple variations and modification to the disclosed (exemplary) embodiments will occur, to the extent not mutually exclusive, to those skilled in the art upon consideration of the foregoing description. Additionally, other combinations, omissions, substitutions and modifications will be apparent to the skilled artisan in view of the disclosure herein. Accordingly, the present invention is not intended to be limited by the disclosed embodiments, but is to be defined by reference to the appended claims.

While a preferred embodiment of the electrical static discharge method and apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the material described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. Electrical Static Discharge (ESD) system comprising:

a user-accessible subsystem wherein the user-accessible subsystem is a plurality of first gasoline pumps operative for dispensing gasoline into a plurality of motor vehicles, each first gasoline pump of the plurality of first gasoline pumps having a hose, each first gasoline pump of the plurality of first gasoline pumps including:

(i) a mat operative for a person to stand upon, the mat operative to conduct a static electric charge from a user's feet to a local ground before the user accesses the plurality of first gasoline pumps;

(ii) a touch pad operative to be touched by the user's hand and to conduct the static electric charge from the user's hand to the local ground before the user accesses the plurality of first gasoline pumps; and (iii) a handle operative to be touched by the user's hand and to conduct the static electric charge from the user's hand to the local ground while the user accesses the plurality of first gasoline pumps, the handle having a metallic tape along the hose such that the user's hand has a path including the metallic tape from the handle to the local ground;

the local ground operatively coupled to the user-accessible subsystem, the local ground operative to dissipate the static electric charge from the user-accessible subsystem;

a resistor-fuse element coupled to conduct the static electric charge from the local ground and to limit a reverse electric current to the local ground; and a main ground coupled to receive and to dissipate the static electric charge from the resistor-fuse element;

wherein the local ground is operatively coupled to the plurality of first gasoline pumps to dissipate the static electric charge from each of the first gasoline pumps of the plurality of first gasoline pumps.

* * * * *